US007234566B2

(12) United States Patent
Simmons

(10) Patent No.: US 7,234,566 B2
(45) Date of Patent: Jun. 26, 2007

(54) ELEVATOR INSERT

(75) Inventor: John Scott Simmons, Williamston, MI (US)

(73) Assignee: The Vertical Solutions Company, Inc., Williamston, MI (US)

( * ) Notice: Subject to any disclaimer, the term of this patent is extended or adjusted under 35 U.S.C. 154(b) by 246 days.

(21) Appl. No.: 10/940,122

(22) Filed: Sep. 14, 2004

(65) Prior Publication Data

US 2005/0098392 A1 May 12, 2005

Related U.S. Application Data

(60) Provisional application No. 60/502,797, filed on Sep. 15, 2003.

(51) Int. Cl.
*B66B 7/02* (2006.01)

(52) U.S. Cl. ..... 187/408; 187/406; 187/414; 104/124; 104/127; 52/710; 52/244; 52/301; 211/207; 248/674; 248/679

(58) Field of Classification Search ..... 187/406, 187/408; 211/94.01, 102, 103, 190, 207, 211/193; 248/674, 679, 694, 207, 327, 669; 104/127, 307, 140; 52/244, 301, 710, 711; *B66B 7/02, B66B 7/06, 11/06, 11/068*
See application file for complete search history.

(56) References Cited

U.S. PATENT DOCUMENTS

| | | | | |
|---|---|---|---|---|
| 1,172,664 | A * | 2/1916 | Banes | 52/707 |
| 1,245,414 | A * | 11/1917 | Widmer | 52/699 |
| 1,546,901 | A * | 7/1925 | Jordahl | 52/708 |
| 1,556,607 | A | 10/1925 | Kane | |
| 1,581,262 | A | 4/1926 | Zabriskie | |
| 1,896,900 | A | 2/1933 | Kiesling | |
| 2,321,106 | A | 6/1943 | Sanford | |
| 2,463,215 | A | 3/1949 | Strachan | |
| 3,199,642 | A | 8/1965 | Anderson | |
| 3,880,258 | A | 4/1975 | Rompa | |
| 4,073,114 | A | 2/1978 | Irish | |
| 4,231,148 | A | 11/1980 | Harding | |
| 4,431,087 | A | 2/1984 | Karol | |
| 4,577,729 | A | 3/1986 | Karol | |
| 4,593,794 | A | 6/1986 | Russeau | |
| 4,664,230 | A | 5/1987 | Olsen | |
| 4,948,313 | A | 8/1990 | Zankovich | |
| 5,357,721 | A | 10/1994 | Alvarez | |
| 5,520,264 | A | 5/1996 | Korhonen | |
| 6,012,554 | A | 1/2000 | Ito et al. | |
| 6,196,356 | B1 | 3/2001 | Sneed | |
| 6,446,762 | B1 | 9/2002 | St. Pierre et al. | |
| 6,481,538 | B2 | 11/2002 | Blackaby et al. | |
| 2003/0168291 | A1 | 9/2003 | Sneed | |

FOREIGN PATENT DOCUMENTS

DE 3817756 C1 * 11/1989

* cited by examiner

*Primary Examiner*—Gene O. Crawford
*Assistant Examiner*—Stefan H Kruer
(74) *Attorney, Agent, or Firm*—Ian C. McLeod; Steven E. Merritt

(57) ABSTRACT

Inserts (10 or 10A) for mounting rails (302) for rollers (301) on a cab in a shaft (300) of an elevator are described. Also, insert 10A is particularly useful for mounting flooring in the elevator shaft (300). The insert can be used as a support for a hoist or winch (310).

15 Claims, 8 Drawing Sheets

ELEVATOR INSERT

CROSS-REFERENCE TO RELATED APPLICATIONS

This application claims the benefit of U.S. Provisional Application Ser. No. 60/502,797 filed Sep. 15, 2003.

STATEMENT REGARDING FEDERALLY SPONSORED RESEARCH OR DEVELOPMENT

Not Applicable.

BACKGROUND OF THE INVENTION (1) Field of the Invention

The present invention relates to improved inserts which are mounted on walls of an elevator shaft to support rails for guiding a cab in the shaft. In particular, the present invention relates to a tubular insert.

(2) Description of the Related Art

The prior art has shown a variety of inserts for providing support, particularly for elevator rails. Illustrative are U.S. Pat. No. 936,690 to Alford; U.S. Pat. No. 1,172,664 to Banes; U.S. Pat. No. 1,245,414 to Widmer; U.S. Pat. No. 1,546,901 to Jordahl; U.S. Pat. No. 1,556,607 to Kane; U.S. Pat. No. 1,581,262 to Zabriskie; U.S. Pat. No. 1,896,900 to Kiesling; U.S. Pat. No. 2,321,106 to Sanford; U.S. Pat. No. 2,463,215 to Strachan; U.S. Pat. No. 3,199,642 to Anderson; U.S. Pat. No. 3,880,258 to Rompa; U.S. Pat. No. 3,978,358 to Atkey; U.S. Pat. No. 4,073,114 to Irish; U.S. Pat. No. 4,231,148 to Harding; U.S. Pat. No. 4,431,087 to Karol; U.S. Pat. No. 4,577,729 to Karol; U.S. Pat. No. 4,593,794 to Russeau; U.S. Pat. No. 4,664,230 to Olsen; U.S. Pat. No. 4,948,313 to Zankovich; U.S. Pat. No. 5,357,721 to Alvarez; U.S. Pat. No. 5,520,264 to Korhonen; U.S. Pat. No. 6,012,554 to Ito et al; U.S. Pat. No. 6,196,356 to Sneed; U.S. Pat. No. 6,446,762 to St. Pierre et al and U.S. Pat. No. 6,481,538 to Blackaby et al. Also, U.S. Application Publication No. 2003/0168291.

OBJECTS

It is therefore an object of the present invention to provide an elevator insert which is stronger and more versatile than a prior art insert. Further, it is an object of the present invention to provide an insert which is relatively simple to manufacture.

These and other objects will become increasingly apparent by reference to the following description and the drawings.

SUMMARY OF THE INVENTION

Thus, the present invention relates to a support insert which comprises: an integral tubular member with a rectangular cross-section and with four faces between opposed ends, wherein a first of the faces has two opposed elongate slots between the opposed ends leading to rectangular openings adjacent to each of the opposed ends of the tubular member and a rectangular opening centrally of the tubular member between the opposed elongate slots, wherein the slots in the tubular member are adapted to slidingly position shafts of bolts in the elongate slots with a head of the bolt inside the tubular member. Preferably, the tubular member has a square cross-section. Preferably, the bolt to be slidingly positioned is a ⅝" bolt. In one embodiment, an opposite of the faces from the first of the faces has openings for receiving additional bolts for mounting of the inert through the rectangular openings. In another embodiment, wherein an opposite of the faces from the first face has a series of fasteners mounted on the opposite face adapted for retaining of the insert in concrete. Preferably, the insert is configured to be mounted in an elevator shaft to support rails for the cab. In another embodiment, the support is configured to be mounted in a floor of an elevator. In still another embodiment, the insert is configured to be mounted in a roof of a shaft to use as a temporary hoist winch for mounting a cab of an elevator shaft. Preferably, the slots and openings have been machined into the tubular member.

The present invention relates to an improvement in a vertical elevator in a building with a vertical shaft, for supporting a cab to be elevated, with walls and rails mounted on the walls, which comprises: multiple horizontally mounted support inserts for the rails on the walls comprising integral metal tubular members each with a rectangular cross-section and with four faces between opposed ends, wherein a first of the faces has two opposed elongate slots between the opposed ends leading to rectangular openings adjacent to each of the opposed ends of the tubular member and a rectangular opening centrally of the tubular member between the opposed elongate slots, wherein the slots in the tubular member are adapted to slidingly position a shaft of a bolt in the elongate slot with a head of the bolt inside the tubular member for mounting the rails. Preferably, the tubular member has a square cross-section. Preferably, the bolt to be slidingly positioned in the support insert is a ⅝" bolt. Preferably, the support insert has an opposite of the faces from the first of the faces with openings with additional bolts for mounting of the insert through the rectangular openings and wherein the inserts are mounted on the walls with the bolts. In one embodiment, an opposite of the faces from the first face of the support insert has a series of fasteners mounted on the opposite face adaptor for retaining of the insert in concrete and wherein the fasteners are mounted in the walls which are concrete. In another embodiment, the insert is mounted by welding to cross beams provided in the elevator shaft. Preferably, wherein the slots and rectangular openings have been machined into the tubular member. In another embodiment, wherein the additional inserts are in addition mounted in a concrete floor of the elevator and have fasteners which are embedded in the concrete so that the insert provides a support for flooring in the elevator. In still another embodiment, wherein an additional of the inserts are temporarily fastened to a ceiling of the elevator to secure a hoist or winch for mounting the cab in the shaft.

BRIEF DESCRIPTION OF THE PREFERRED EMBODIMENTS

Figures 1, 2, 3:
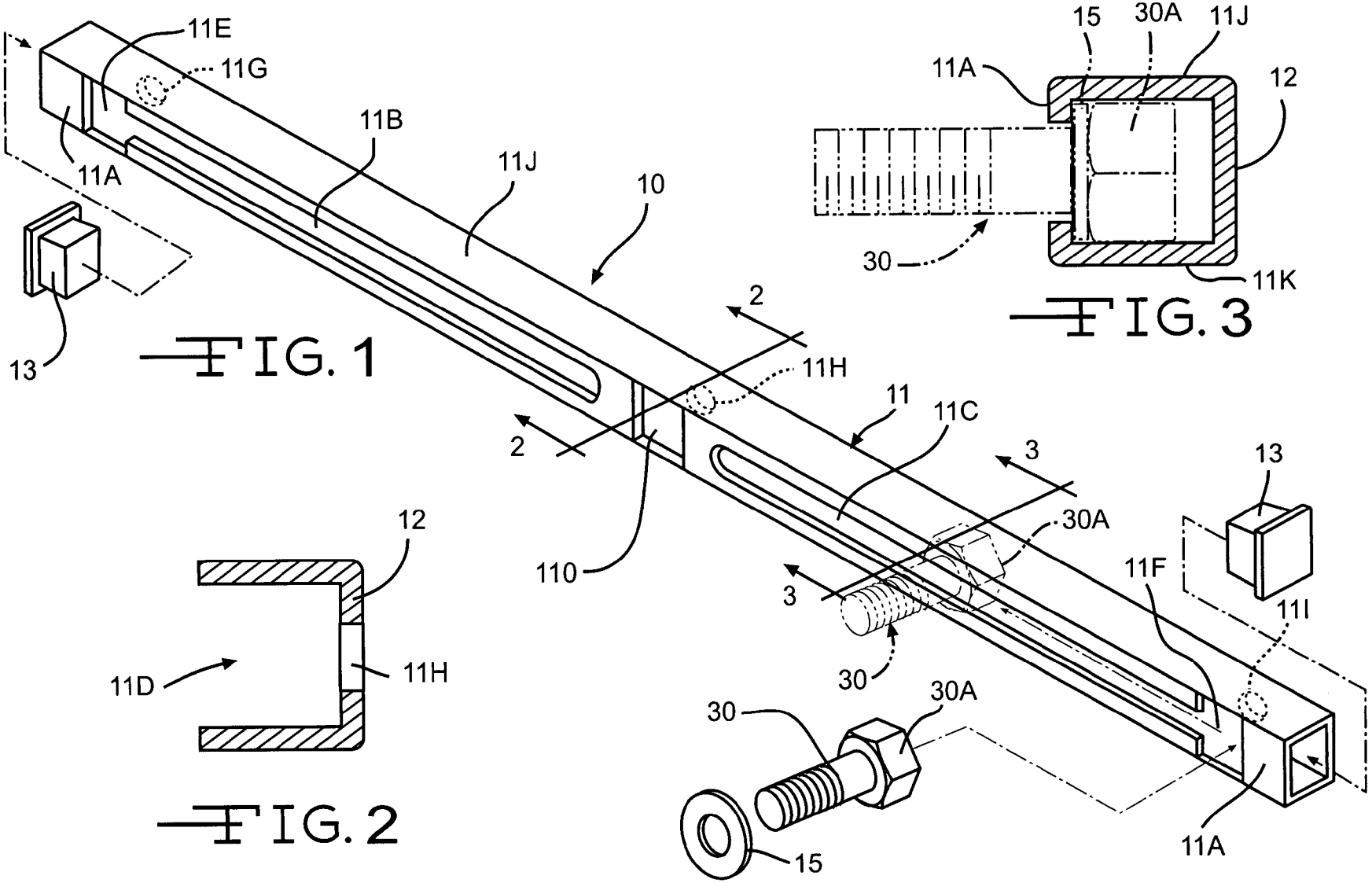
FIG. 1 is a perspective view of the improved insert 10 of the present invention.
FIG. 2 is a cross-section along line 2-2 of FIG. 1.
FIG. 3 is a cross-section along line 3-3 of FIG. 1.
Figure 6:
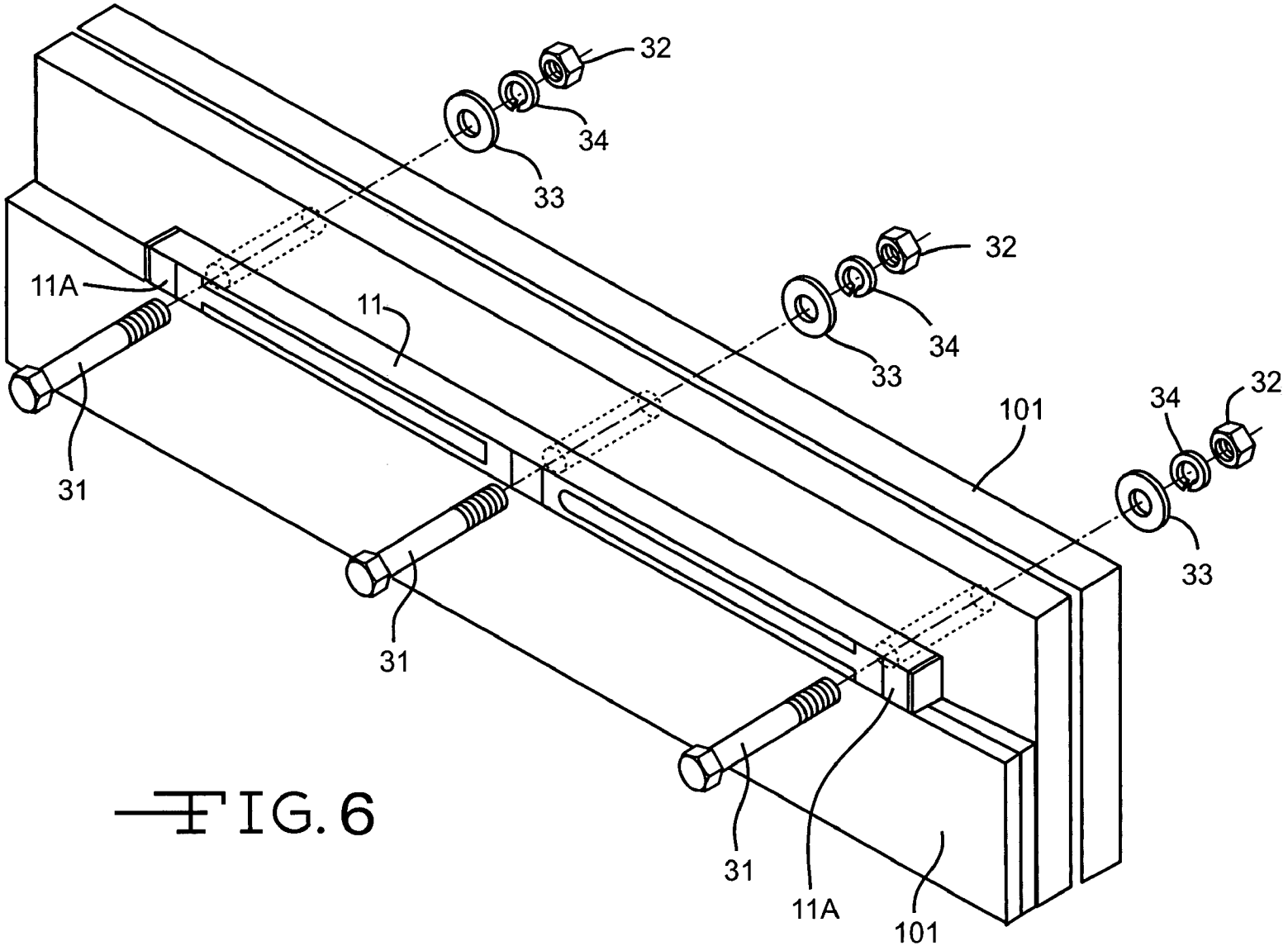
FIG. 6 is a perspective separated view of the insert 10 to be fastened by bolts and nuts through cross-beams 101 which are part of the elevator shaft (not shown).
Figure 9:
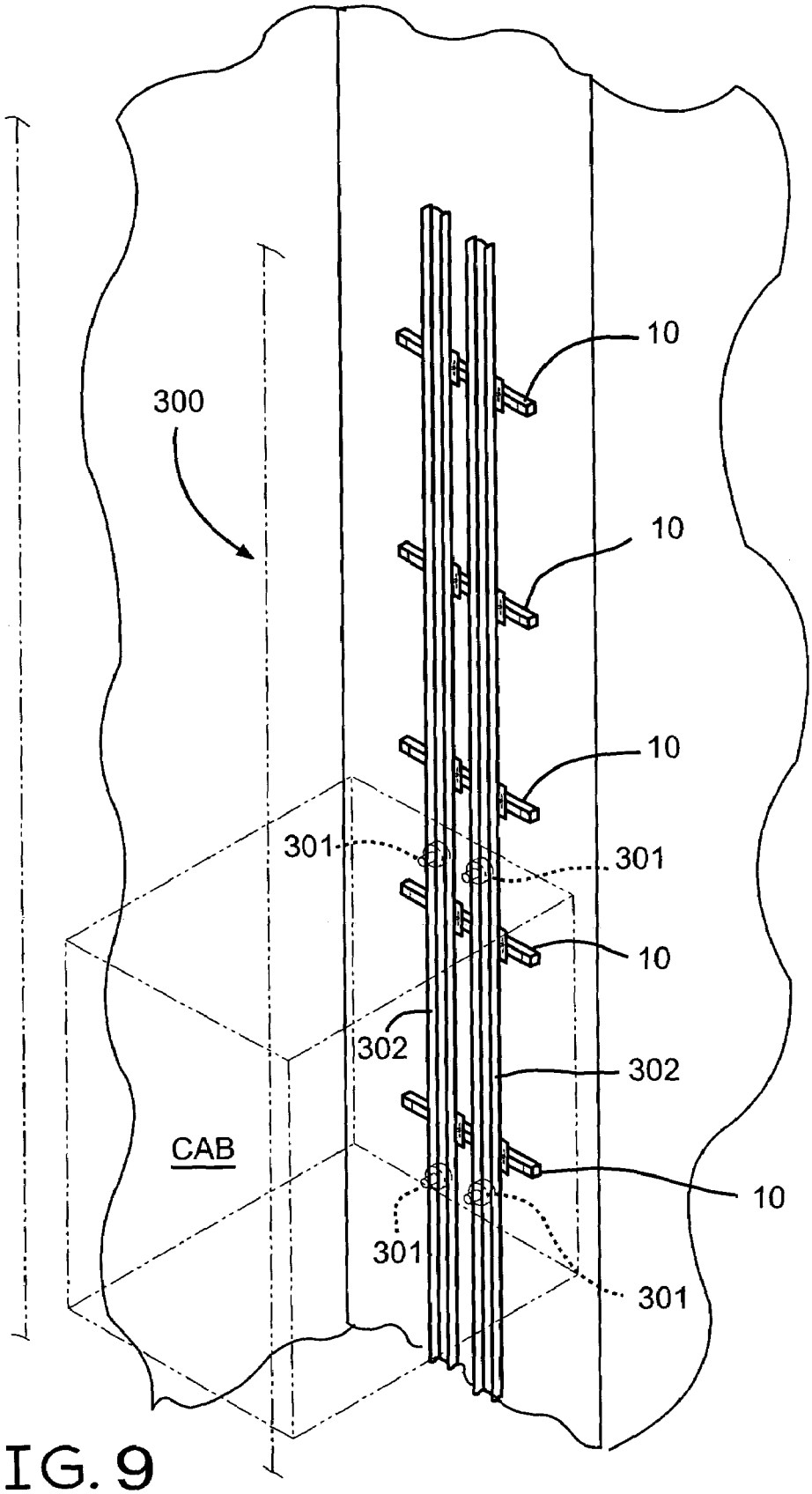
FIG. 9 is a drawing in perspective view of half of an elevator shaft 300 showing inserts 10 mounted on one wall of the shaft 300. An opposed wall of the shaft 300 mounts identical inserts 10 (not shown).

FIGS. 1 to 3 show insert 10 comprised of elongate integral tubular member 11. Through face 11A there are two (2) elongate slots 11B and 11C which are positioned adjacent to a center rectangular opening 11D in the face 11A. At opposed ends of the face 11A are second and third rectangular openings 11E and 11F. The rectangular openings 11E and 11F are adapted to receive a threaded bolt 30 and head 30A, preferably with a washer 15. On a face 11A opposite the rectangular openings 11D, 11E and 11F are openings adapted to receive additional mounting bolts 31 through holes 11G, 11H and 11I with nuts 32, washers 33 and lock washers 34 for securing the insert 10 to a brace 101 of the wall 104 of an elevator shaft 300 as depicted in FIG. 6. The bolts 30 are inserted through openings 11E and 11F and positioned in slots 11B and 11C for mounting rails 302 for engagement with rollers 301 on the cab as seen in FIG. 9. The insert 10 can optionally have plugs 13 at either end which extend into the inside of the tubular member 11 in a press fit.

Figures 4, 4A:
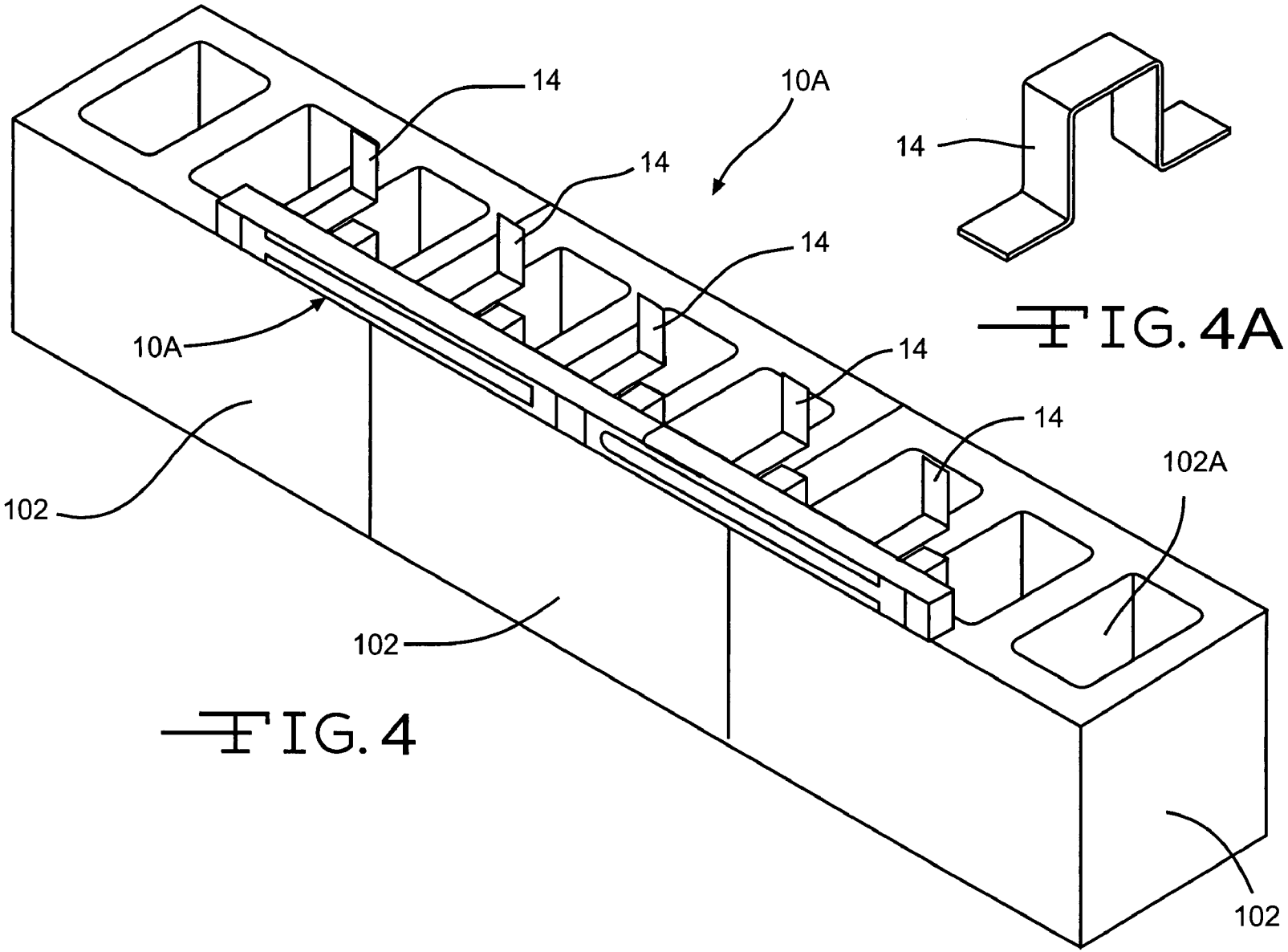
FIG. 4 is a perspective view of an insert 10A provided with fasteners 14 or securing the insert 10A in concrete blocks 102.
FIG. 4A is a perspective view of the fastener 14 shown in FIG. 4.

FIG. 4 shows an insert 10A mounted by fasteners or feet 14 in a block wall 102 of the shaft 300. The insert 10A is identical to FIG. 1 except for the fasteners or feet 14. The holes 11G, 11H and 11I are unnecessary, but can be present. The openings 102A can be filled with concrete to secure the fasteners 14 into the wall 102. The fasteners 14 are typically welded to insert 10A on opposite face 11A (FIG. 12).

Figure 5:
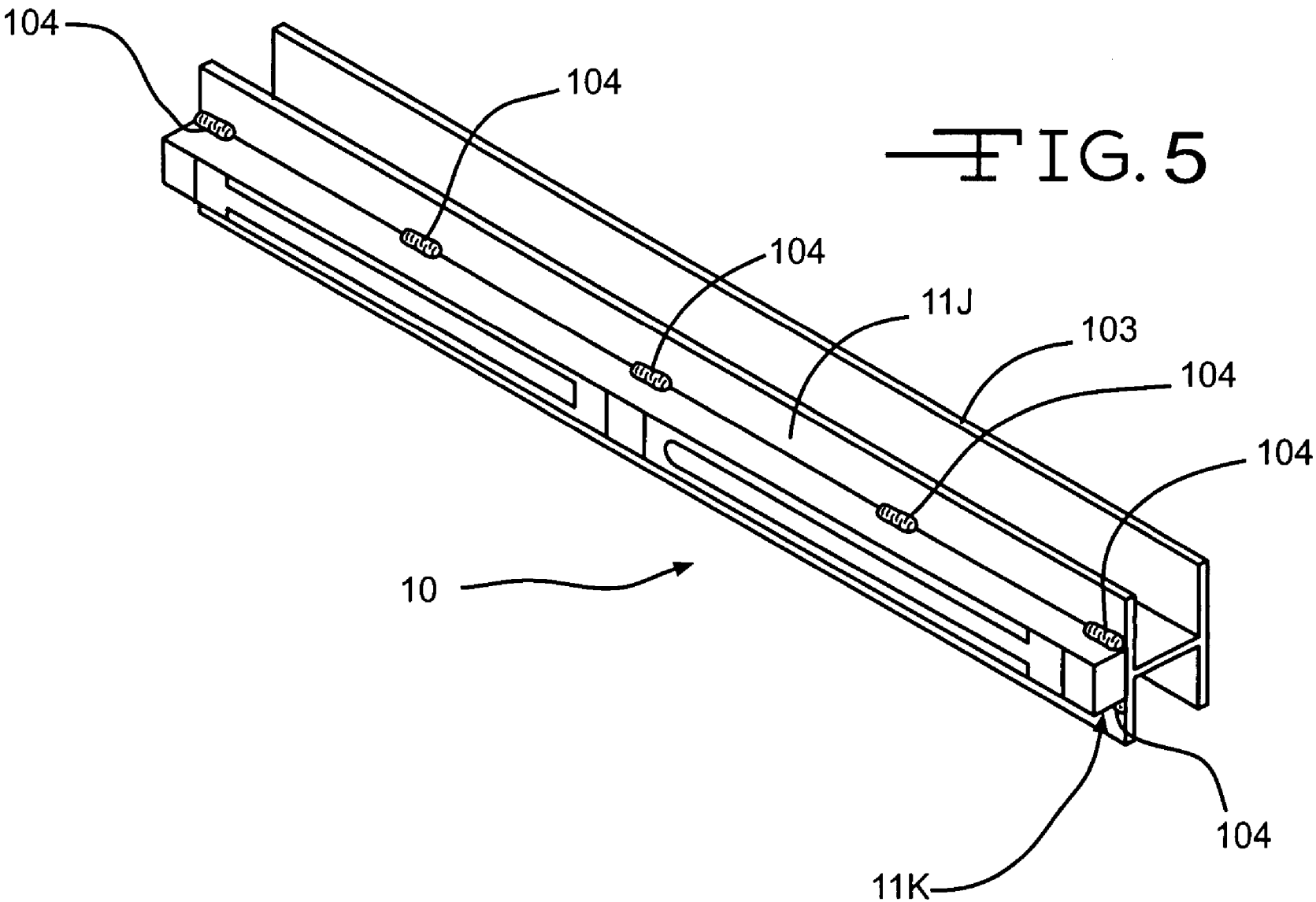
FIG. 5 is a perspective view of the insert 10 secured by welds 104 to an I-beam 103 which is part of the elevator shaft (not shown).

FIG. 5 shows the insert 10 welded to a cross-beam 101 of an elevator shaft 300 by welds 104 on an upper face 11J and a lower face 11K of the insert 10 (see also FIGS. 1 to 3). The holes 11G, 11H and 11I are unnecessary, but can be present.

Figure 8:
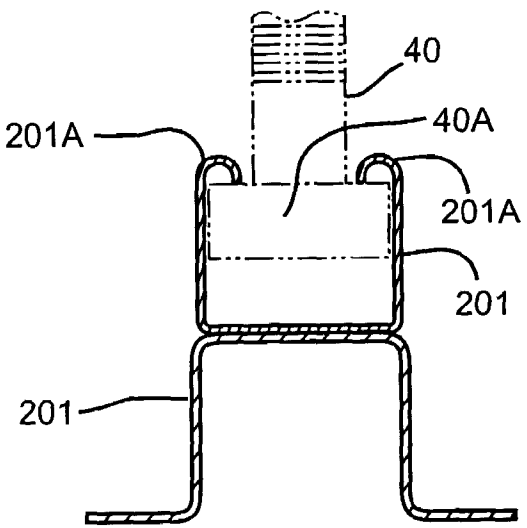
FIG. 8 Prior Art
FIG. 8 is a cross-sectional drawing at 8-8 of FIG. 7 showing the fasteners 204 mounted on the prior art insert 200.
Figure 7:
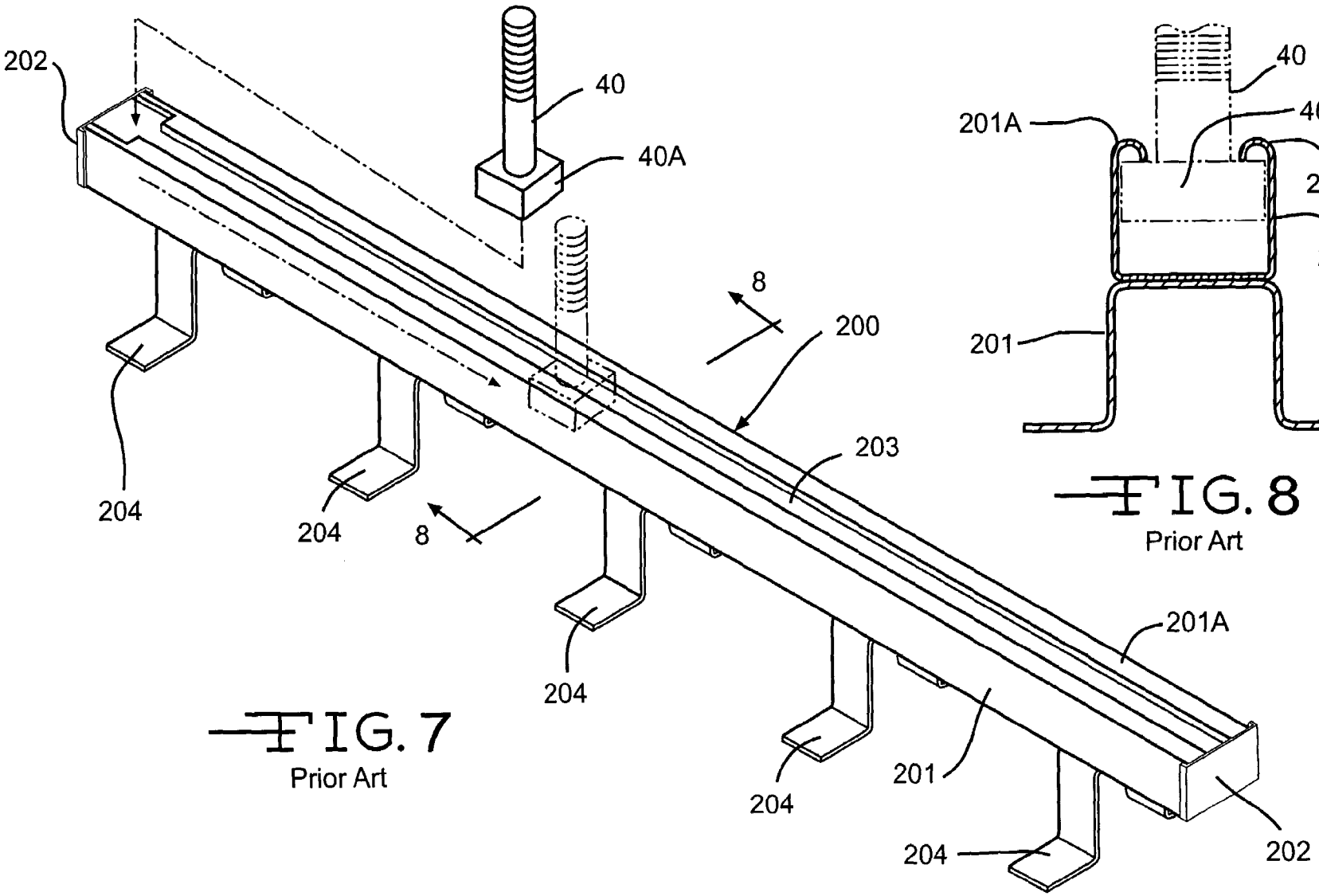
FIG. 7 Prior Art
FIG. 7 is a perspective view of a prior art insert 200 made of a channel 201 with lips 201A for mounting a bolt 201.

FIGS. 7 and 8 show a prior art insert 200 made of a channel 201 which requires a special bolt 40 with a square head 40A. Caps 202 are welded to ends of the insert 200 to prevent sliding of the bolts 40 out of the insert 200. The insert 200 is relatively weak, as can be seen from the following experimental data, because of the elongate slot 203 from end to end of the channel 201.

FIG. 9 shows the elevator shaft 300 supporting multiple of the inserts 10 and mounting rails 302 for rollers 301 mounted on the cab. For ease of reference, one (1) wall of shaft 300 is shown; however, in practice, the shaft 300 would have rails 302 on at least the opposite wall and sometimes on a rear wall relative to the cab.

Figure 10:
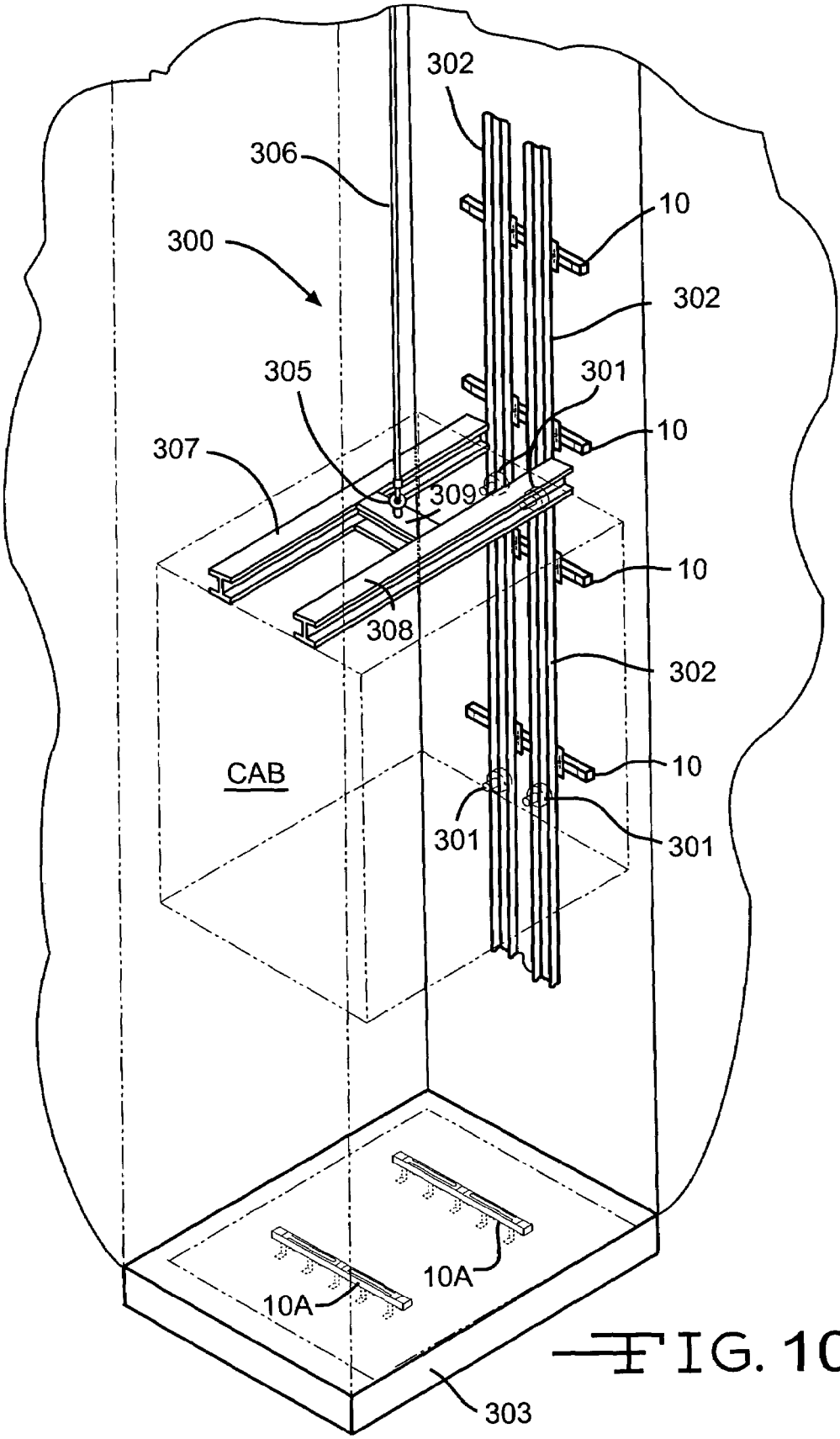
FIG. 10 is a drawing in perspective view showing the insert 10A being used in a concrete floor 303 with the slots 203 and openings exposed to support a floor (not shown) in the shaft 300 and an eye bolt 305 and cable 306 mounted on cross-beams 307, 308 and 309 for moving the cab into the elevator.

FIG. 10 shows the insert 10A used in a floor embedded in concrete 303 to provide a means for securing a steel floor (not shown) in the elevator.

Figure 11:
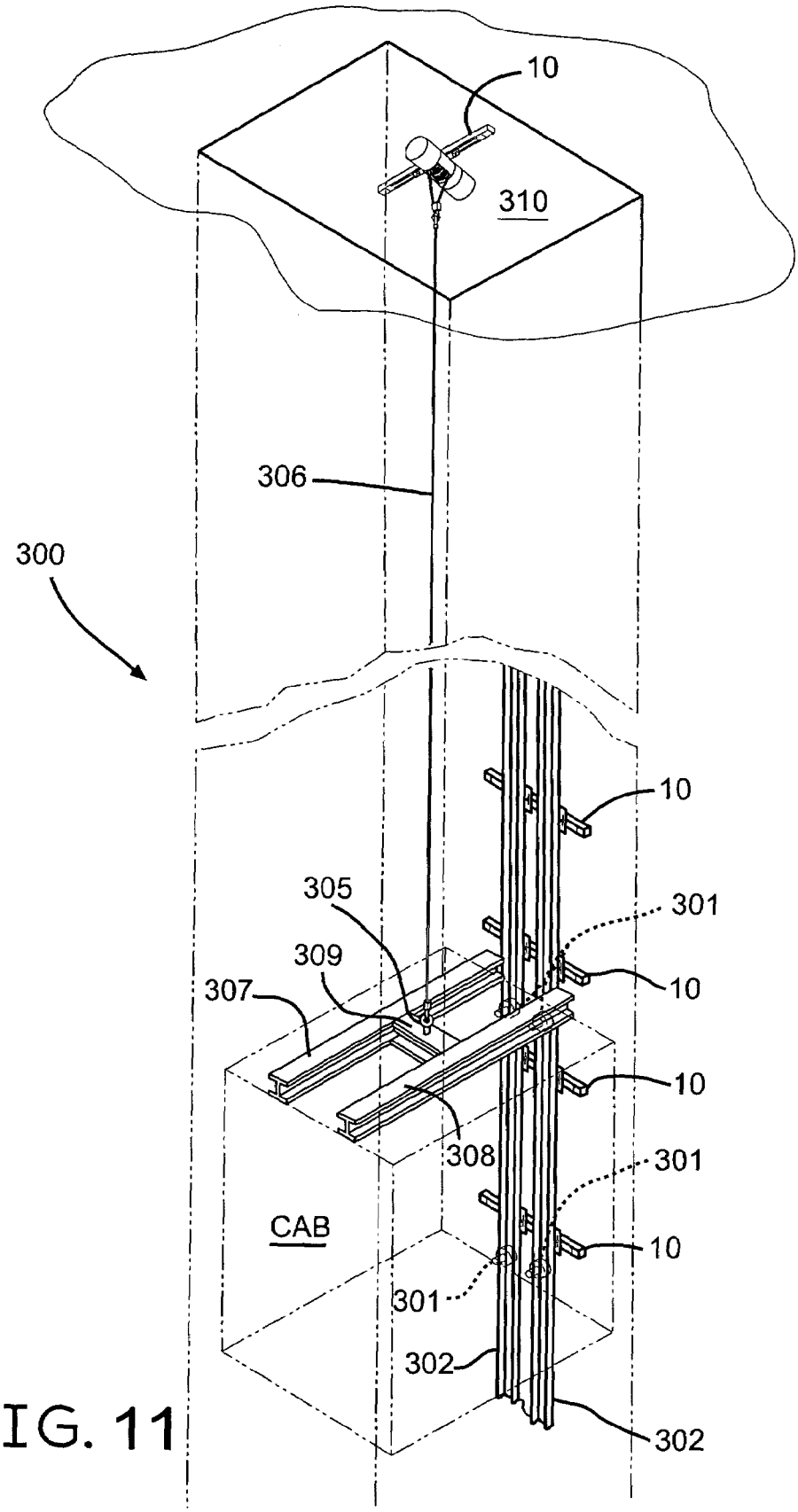
FIG. 11 is a perspective view as a continuation of FIG. 10 showing a hoist or winch 310 mounted on insert 10 which is secured to a ceiling of the shaft 300.

FIGS. 10 and 11 together also show the insert 10 used as a support for a winch or hoist 310 enabling moving the cab into the shaft 300. The insert 10 is left in position when the winch 310 is removed for future use if the need arises. The hoist or winch 310 is connected by cable 306 to the eye bolt 305 mounted on the cross-beams 307, 308 and 309.

The insert 10 or 10A is generally constructed of square steel tubing which is commercially available; although, other high strength metals could be used. The metal is preferably machinable as well; although, stamping could be used.

Strength tests were conducted on the insert 10 of FIGS. 1 to 3 versus the prior art insert 200 of FIGS. 7 and 8. The test results are as follows:

TESTING RESULTS

Using an Instron model 4206 testing machine, failure tests were conducted. Three, ⅝" diameter, grade 5 bolts were installed in the new style insert. These bolts were installed in three different locations on the insert 10; the middle of the slot (weakest), slightly off-center of the middle-point of the insert 10 and the last was installed with a washer under the head of the bolt near the end of the insert 10. The insert 10 was tested to complete failure, in other words, if a bucket of water was hanging from the insert 10, when the final drop of water fell in the bucket and the insert 10 reached its capacity, it would pull loose and fall . . . complete failure.

Weakest point=6,832 pounds

Middle of insert=8,816 pounds

End of insert with washer under the head=12,562 pounds

The insert of FIGS. 7 and 8 currently in use by the industry is made from a piece of uni-strut. This insert was also tested. The complete failure load in this test was 4,231 pounds.

Thus, in reference to pullout of the bolt, the insert is more than 50% stronger. Preferably, a washer 15 is used under the head of the bolt as in FIG. 1.

Typically, one (1) rail is used on each side of the elevator. With traction elevators, having a counterweight, the counterweight is supported between rails at the rear of the elevator which can be supported by insert 10 or 10A. All of this is well known to those skilled in the art.

It is intended that the foregoing description be only illustrative of the present invention and that the present invention be limited only by the hereinafter appended claims.

I claim:

1. A support insert which comprises: an integral tubular member with a rectangular cross-section and with four faces between opposed ends, wherein a first of the faces has two opposed elongate slots between the opposed ends leading to rectangular openings adjacent to each of the opposed ends of the tubular member and a rectangular opening centrally located between the opposed, elongated slots of the tubular member, wherein the slots in the tubular member are adapted to slidingly position shafts of bolts in the elongate slots with a head of the bolt inside the tubular member and wherein an opposite of the faces from the first of the faces has openings for receiving additional bolts for mounting of the insert through the rectangular openings.

2. The support insert of claim 1 wherein the tubular member has a square cross-section.

3. The support insert of claim 2 wherein the bolt to be slidingly positioned is a ⅝" bolt.

4. The support insert of any one of claims 1, 2 or 3 wherein an opposite of the faces from the first face has a series of fasteners mounted on the opposite face adapted for retaining of the insert in concrete.

5. The support insert of any one of claims 1, 2 or 3 wherein the insert is configured to be mounted in an elevator shaft to support rails for a cab.

6. The support insert of any one of claims 1, 2 or 3 wherein the support is configured to be mounted in a floor of an elevator.

7. The support insert of any one of claims 1, 2 or 3 wherein the insert is configured to be mounted in a roof of a shaft to use as a temporary hoist or winch for mounting a cab of an elevator shaft.

8. The support insert of any one of claims 1, 2 or 3 wherein the slots and openings have been machined into the tubular member.

9. In a vertical elevator in a building with a vertical shaft, for supporting a cab to be elevated, with rails mounted on the walls, the improvement in support inserts for mounting the rails on the walls, which comprises:

multiple horizontally mounted support inserts on the walls comprising integral metal tubular members each with a rectangular cross-section and with four faces between opposed ends, wherein a first of the faces has two opposed elongate slots between the opposed ends leading to rectangular openings adjacent to each of the opposed ends of the tubular member and a rectangular opening centrally located between the opposed, elongated slots of the tubular member, wherein the slots in the tubular member are adapted to slidingly position a shaft of a bolt in the elongate slot with a head of the bolt inside the tubular member for mounting the rails and wherein the support insert has an opposite of the faces from the first of the faces with openings with additional bolts for mounting of the insert through the rectangular openings and wherein the inserts are mounted on the walls with the bolts.

10. The elevator of claim 9 wherein the tubular member has a square cross-section.

11. The elevator of claim 9 wherein the bolt to be slidingly positioned in the support insert is a ⅝" bolt.

12. The elevator of any one of claims 9, 10 or 11 wherein an opposite of the faces from the first face of the support insert has a series of fasteners mounted on the opposite face adaptor for retaining of the insert in concrete and wherein the fasteners are mounted in the walls which are concrete.

13. The elevator of any one of claims 9, 10 or 11 wherein the insert is mounted by welding to cross beams provided in the shaft of the elevator.

14. The elevator of any one of claims 9, 10 or 11 wherein the additional inserts are in addition mounted in a concrete floor of the elevator and have fasteners which are embedded in the concrete so that the insert provides a support for flooring in the elevator.

15. The elevator of any one of claims 9, 10 or 11 wherein an additional of the inserts are temporarily fastened to a ceiling of the elevator to secure a hoist or winch for mounting the cab in the shaft.

* * * * *